United States Patent [19]

Fujita et al.

[11] 4,231,797

[45] Nov. 4, 1980

[54] FIRED IRON-ORE PELLETS HAVING MACRO PORES

[75] Inventors: Isao Fujita, Kobe; Mamoru Onoda, Miki; Fumikazu Kawaguchi, Kobe; Yoshimichi Takenake, Kobe; Tadao Tsutaya, Kobe, all of Japan

[73] Assignee: Kobe Steel, Limited, Kobe, Japan

[21] Appl. No.: 1,837

[22] Filed: Jan. 8, 1979

Related U.S. Application Data

[63] Continuation of Ser. No. 774,067, Mar. 3, 1977, abandoned.

[30] Foreign Application Priority Data

Mar. 3, 1976 [JP] Japan ..... 51-23647

[51] Int. Cl.[3] ..... B22F 3/10

[52] U.S. Cl. ..... 75/256; 428/613

[58] Field of Search ..... 75/3, 4, 5, 33–37, 75/40–42, 222, 256; 428/613

[56] References Cited

U.S. PATENT DOCUMENTS

| | | | |
|---|---|---|---|
| 2,356,024 | 8/1944 | Anderson et al. | 75/5 |
| 2,696,432 | 12/1954 | Davis | 75/5 |
| 3,189,436 | 6/1965 | Burstlein | 75/5 |
| 3,313,617 | 4/1967 | Ban et al. | 75/5 |
| 3,754,889 | 8/1973 | Dominguez et al. | 75/5 |
| 4,082,539 | 4/1978 | Sugawasa | 75/5 |
| 4,082,540 | 4/1978 | Sasak et al. | 75/5 |

FOREIGN PATENT DOCUMENTS

| | | | |
|---|---|---|---|
| 2121520 | 11/1972 | Fed. Rep. of Germany | 75/3 |
| 48-25281 | 7/1973 | Japan | 75/5 |

OTHER PUBLICATIONS

Perry, J. H. ed; Chemical Engineers Handbook, 4th ed. McGraw Hill, N.Y. New York, pp. 9-3, 9-4 (1963).

Merriman, A.D.; *A Dictionary Of Metallurgy* Mac Donald & Evans, London, pp. 165–224 (1958).

*Primary Examiner*—L. DeWayne Rutledge
*Assistant Examiner*—Michael L. Lewis
*Attorney, Agent, or Firm*—Oblon, Fisher, Spivak, McClelland & Maier

[57] ABSTRACT

Fired iron-ore pellets are disclosed which are prepared by crushing iron ore to be pelletized, mixing a carbonaceous material of grain sizes ranging from 0.1 to 3 mm in diameter to the crushed iron ore in an amount of up to 4% by weight, pelletizing the mixture thus prepared, and firing the resulting pellets; thereby providing pellets throughout each of which is dispersed macro-pores of sizes ranging from 0.1 to 3 mm in diameter at a ratio of up to 25% relative to all pores contained in each pellet.

1 Claim, 10 Drawing Figures

FIRED IRON-ORE PELLETS HAVING MACRO PORES

This is a continuation of application Ser. No. 774,067, filed Mar. 3, 1977, now abandoned.

BACKGROUND OF THE INVENTION

1. Field of the Invention

The present invention relates to fired iron-ore pellets and to a process for producing the same. More particularly, the invention relates to pellets for use in the production of pig iron in a blast furnace, wherein the pellets exhibit significant reducing properties as well as excellent softening and sticking properties over a high temperature range, i.e., the pellets exhibit excellent behavior and properties over a high temperature range.

2. Description of the Prior Art

The prior art iron-ore pellets which are charged into blast furnaces are classified into several types, i.e., acid pellets and self-fluxing pellets containing limestones and so on. These pellets are produced particularly in an attempt to increase the tumbler index and to improve the reducibility of pellets which characteristics are described in Japanese Industrial Standards (JIS M-8713), by improving the compressive strength and porosity of the pellets. However, the prior art pellets do not necessarily possess satisfactory behavior in their reduction characteristics at high temperature ranges in the lower part of a blast furnace (in the belly of the furnace and in the lower portions thereof), because of hindered gas flow into the inner portions of the pellets, which is attributable to the fact that the sizes of the pores in the pellets are less than 0.1 mm, and that the metallic iron in the outer peripheral portions of the pellets forms shell layers. As a result, the reduction of the pellets occurs reluctantly and low melting point slags are formed in the pellets, so that the pellets are softened, and the pellets stick to each other, resulting in various operational problems in a blast furnace.

Because of the increasing necessity to prevent air pollution, the amount of dust recovered from the various steps of iron manufacturing has increased because of the provision of highly efficient dust collectors. Recently, various kinds of dusts recovered from such processes have been reused. For instance, the dust from blast furnaces, converters and the like can be used as raw materials for pellets. These dust materials more or less contain carbon and are of a minute grain size so that they tend to produce micro-pores in the fired pellets. In addition, the dust materials also lower the compressive strength and reduction degree of the pellets, which standards are set by JIC, and are therefore not satisfactory as raw materials for pellets.

Furthermore, under a reducing atmosphere at high temperature ranges, metallic iron in the outer shells of the pellets provides a compacted layer therein, while the formation of the liquid-slag phase in the inner portion of the pellets is accelerated, thereby causing clogging of the pores in the pellets with the result that the reduction of the pellets is retarded. In addition, the pellets are of a spherical shape and contact each other in a surface-contacting relationship, and tend to contract to a considerable degree under a load, because of the formation of metallic iron and excluding of slag from the pellets, with the result that there arises a tendency to form large clogs of material in the furnace. Accordingly, the diffusion of gases into the interior regions of the pellets in a blast furnace is hindered, which causes an increased consumption of fuel.

In this manner, when the prior art fired pellets which are charged into a blast furnace descend into a high temperature zone, the reduction of the pellets does not readily occur, with the consequent acceleration of the softening and sticking phenomena of the pellets thereby forming large clogs of pellets. The clogs of the pellets result in a nonuniform flow of gas, hanging, slipping, broken tuyeres, and the like, all of which cause various problems in blast furnace operation.

A need, therefore, continues to exist for a manner in which the shortcomings of the prior art fired pellets can be improved.

SUMMARY OF THE INVENTION

Accordingly, the first object of the present invention is to provide fired iron-ore pellets having micro-pores for use in a blast furnace, and a process for producing the same.

The second object of the present invention is to provide fired iron-ore pellets which exhibit behavior and properties superior to those of prior art pellets not only at high temperature ranges but also at room temperature, and a process for producing the same.

The third object of the present invention is to provide fired iron-ore pellets which exhibit a high gas efficiency and whose reduction is not retarded even in the elevated temperatures of a blast furnace, thereby ensuring a high degree of reduction, and a process for producing the same.

The fourth object of the present invention is to provide fired iron-ore pellets which are free of the softening and sticking phenomena at the high temperature range in a blast furnace, and which reduce operational problems, such as nonuniform flow of gas in the furnace, hanging, slipping, and the like, thereby improving the productivity of the blast furnace, and reducing the coke ratio in addition to a process for producing the same.

The first aspect of the present invention by which the above objects can be achieved is that macro-pores of sizes from 0.1 to 3 mm in diameter are intentionally dispersed in each of the pellets at a ratio of up to 25% relative to the entire pore content of the pellets.

The second aspect of the present invention is that the pellets of the first aspect of the present invention provide slag structures containing MgO.

The third aspect of the present invention is that in the pellets of the second aspect of the invention, MgO is added in an amount of up to 3% by weight.

The fourth aspect of the present invention is that in the pellets of the first aspect of the invention, the preferred range of ratios of macro-pores in the pellets to all pores is between 5 and 25%.

The fifth aspect of the present invention is that in the pellets of the first aspect of the invention, the most preferred range of ratios of the macro-pores to all pores in each of the pellets is between 15 and 25%.

The sixth aspect of the present invention provides a process for producing fired iron-ore pellets in which raw materials for iron-ore pellets are crushed, pelletized and fired. The process is characterized in that carbonaceous materials of grain sizes of 0.1 to 3 mm in diameter are mixed with raw materials after the raw materials are crushed.

The seventh aspect of the present invention is that with respect to the sixth aspect of the present invention, carbonaceous materials of grain sizes ranging from 0.1 to 3 mm in diameter, and a flux containing MgO are mixed with the raw materials for the fabrication of the iron-ore pellets.

The eighth aspect of the present invention is that in the pellets of the seventh aspect, a flux containing MgO is added to the raw materials for the pellets in an amount of up to 3% by weight.

The ninth aspect of the present invention is that in the pellets of the sixth aspect of the invention, macro-pores of a size ranging from 0.1 to 3 mm in diameter are intentionally dispersed in each of the fired iron-ore pellets in amounts of up to 25% relative to all of the entire pores in each pellet.

The tenth aspect of the present invention is that in the pellets of the ninth aspect of the invention, the most preferred range of ratios is macro-pores in each of the fired iron-ore pellets is between 15 and 25%.

DETAILED DESCRIPTION OF THE PREFERRED EMBODIMENTS

Figure 1:
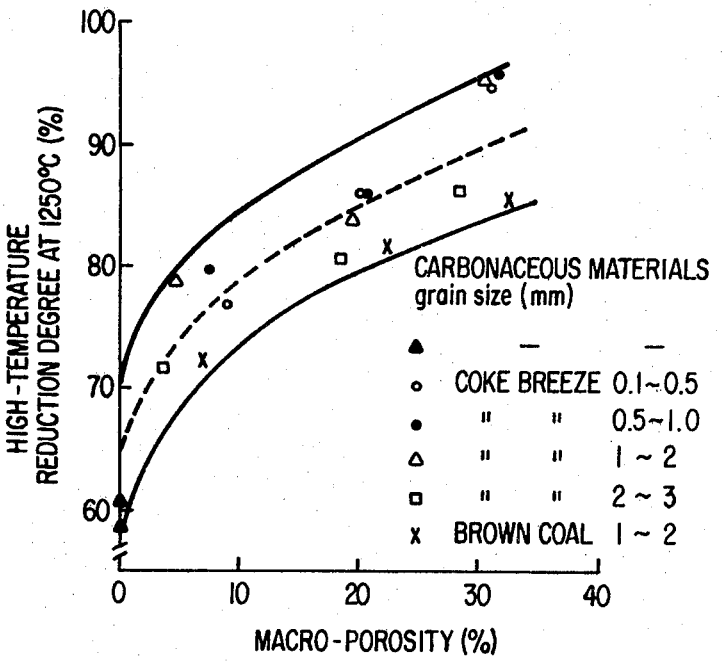
FIG. 1 is a plot showing the relationship between macro-porosity and the degree of reduction at a high temperature of 1250° C., of pellets of the invention.
Figure 2:
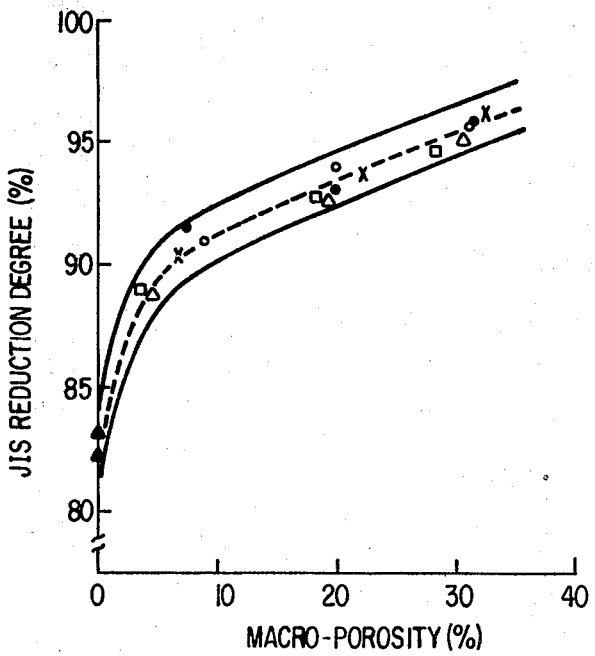
FIG. 2 is a plot showing the relationship between macro-porosity and the degree of reduction for pellets as described by JIS (Japanese Industrial Standards).
Figure 3:
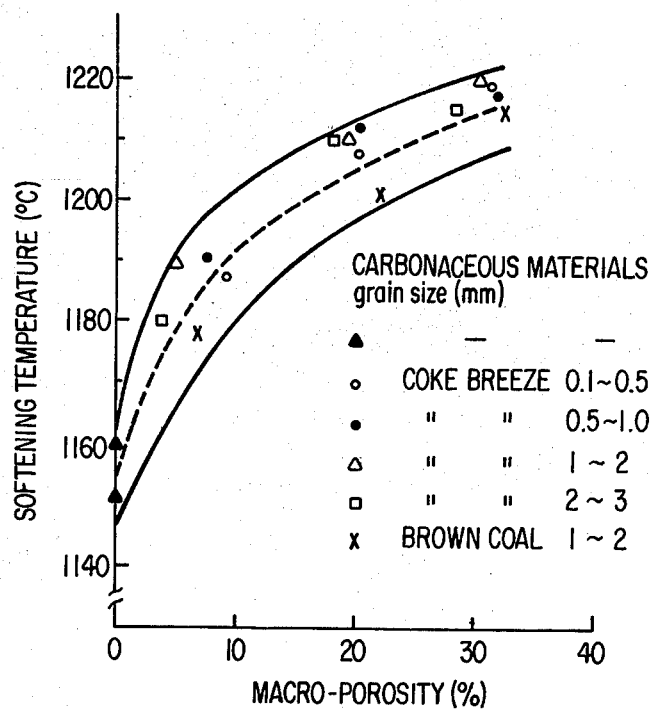
FIG. 3 is a plot showing the relationship of macro-porosity of iron-ore pellets versus a softening temperature.
Figure 4:
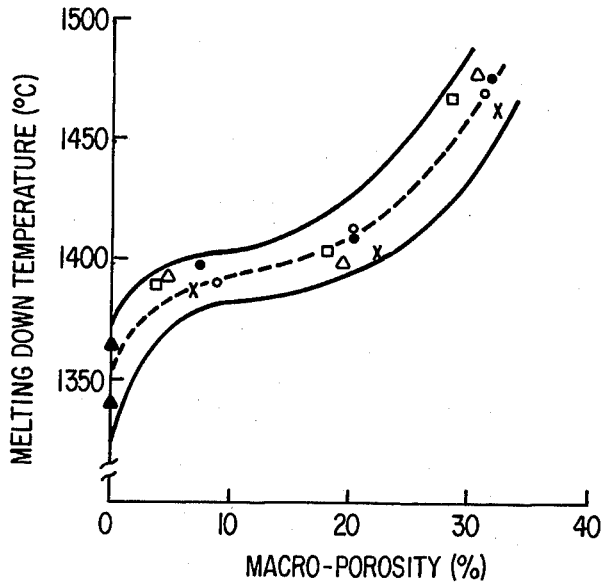
FIG. 4 is a plot showing the relationship between macro-porosity of iron-ore pellets and melting down temperature.

The present invention is directed to a technique of providing a reasonable solution to the shortcomings in the properties and behavior of prior art fired iron-ore pellets. In the present invention, fired iron-ore pellets are fabricated containing macro-pores of sizes ranging from 0.1 to 3 mm in diameter which are intentionally dispersed through the pellets in an amount up to 25% of all of the entire pores. In addition, a process is provided for producing the fired iron-ore pellets, in which carbonaceous materials of sizes of 0.1 to 3 mm in diameter are added in an amount of up to 4% to the other ingredients as raw materials to fabricate the pellets. The mixture thus prepared is pelletized and fired. It should be noted. however, that the present invention is not directed to pellets in which several macro-pores are naturally formed, but to pellets in which macro-pores are intentionally dispersed.

The reason why the upper limit of grain sizes, in diameter, of carbonaceous materials is set at 3 mm is that if the upper limit is exceeded, then difficulty arises during pelletizing. In addition, the reason why the grain sizes of the carbonaceous material are set to the size of macro-pores, i.e., 0.1 to 3 mm, is that carbonaceous materials are burned out of the pellets during firing, so that macro-pores of the same sizes as those of the carbonaceous materials remain in the pellets. In other words, in the present invention, carbonaceous materials of relatively rough or large particle sizes are uniformly mixed with other raw materials for the fabrication of pellets in a suitable amount. Then, the mixture thus prepared is fired in a firing step, thereby intentionally uniformly forming macro-pores in all of the pellets, while the ore grains around the pores are tightly sintered together from the heat of the burning of the carbonaceous materials, thereby imparting the desired properties to the pellet products.

The following tests and experiments for determining the relationship between the quality or properties of the present pellet products and the types and amounts of carbonaceous materials which affect the volumetric ratio of macro-pores produced in the pellets to all pores as well as the sizes of the macro-pores. The pellets used in the present tests were prepared by the following procedure: Coke breeze particles of sizes of 0.1 to 3 mm in diameter and brown coal particles of sizes of 0.1 to 2 mm were added as carbonaceous materials to hematite ore composed of 60 to 95% of particles having grains of sizes of up to 44$\mu$, and of 15 to 20% of particles having grains of sizes of up to 10$\mu$ to the mixture were added bentonite and water and the mixture was hand-pelletized into green pellets of sizes ranging from 11 to 13 mm, after which the green pellets were charged into an Elema furnace for firing under given temperature, heating duration and oxygen partial pressure conditions. Then, the various properties of the pellets were measured or determined.

FIGS. 1 to 6 show the summary of the test results obtained for the iron-ore samples. The graphs show the relationship between macro-porosity of the pellets versus a variety of properties which are the temperature, the melting down temperature, the high temperature reduction degree, the JIS reduction degree, the compressive strength, and the amount of carbonaceous materials added. In the context of the present application, the term "high temperature reduction degree" is defined as the degree of reduction obtained when product pellets are reduced to FeO (Wustite) and then the pellets are reduced at a given temperature of 1250° C. under an atmosphere of $CO:N_2=30:70$. In addition, the term "a softening temperature" is the temperature when pellets are heated under a load of 0.12 kg/cm$^2$ and an atmosphere of $CO:N_2=30:70$ and exhibit a contraction percentage of 10%, while the term "a melting temperature" is defined as the temperature at which pellets contract abruptly and then start dropping off a vessel.

The test results reveal that the metallurgical properties of pellets, such as the high temperature reduction degree, the JIS reduction degree, the softening temperature and the melting down temperature, are increased or enhanced, with an increase in macro-porosity. A macro-porosity of over 5% represents a marked degree of improvement in these properties. In addition, a particularly marked improvement is noted in the melting down temperature at a macro-porosity of over 15%. It can be observed from this fact that this tendency is independent of the types or kinds of carbonaceous materials used to prepare the pellets. From the viewpoint of high temperature properties, it is desirable to define the macro-porosity of pellets to a level of 5%, and it is preferable to set the macro-porosity to above 15%.

Figure 5:
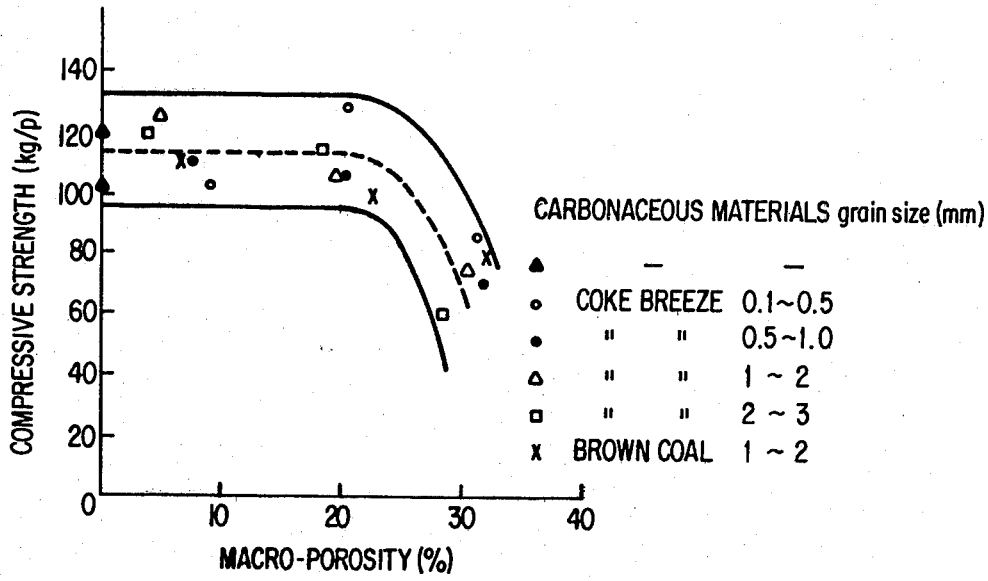
FIG. 5 is a plot showing the relationship between macro-porosity of iron-ore pellets and compressive strength.

Turning to the physical properties of the pellets, it is apparent from FIG. 5 that the compressive strength of the pellet product remains equal to that of the prior art pellets, up to a macro-porosity of up to 25%. However, when the macro-porosity exceeds 25%, the compressive strength of the pellets is sharply reduced. Meanwhile, the compressive strengths in these figures are found to be relatively low, because of the use of a simplified pelletizing operation, such as hand-pelletizing. In practical operation, it can be confirmed that the compressive strengths of the pellets can be increased up to 150 to 200 kg/pellet. For the desired physical properties of the pellets, the macro-porosity should be maintained at a degree less than 25%. Accordingly, a consideration of the metallurgical and physical properties of the pellets leads to the conclusion that the ratio of macro-pores to all of the pores in the pellets should preferably range from 5 to 25%, and desirably from 15 to 25%.

Figure 6:
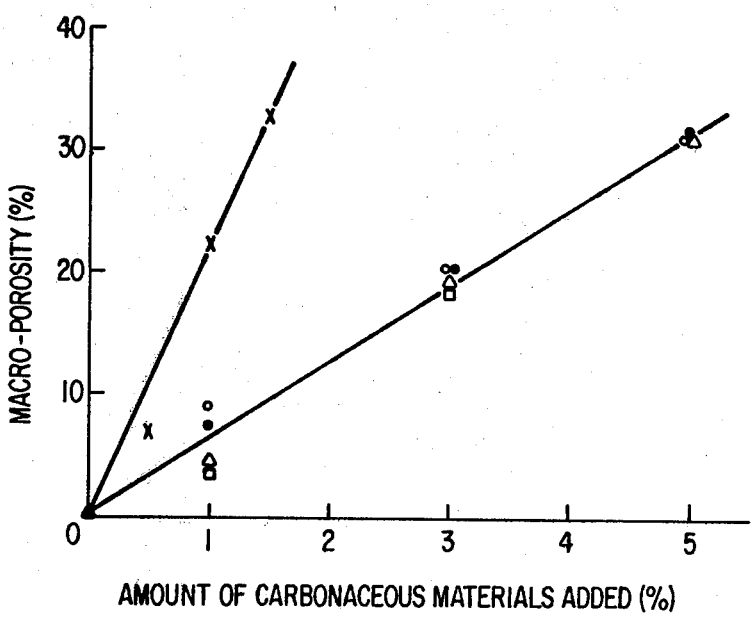
FIG. 6 is a plot showing the relationship between macro-porosity of iron-ore pellets and amounts of carbonaceous materials added.

FIG. 6 shows that the amount and type of carbonaceous material used exerts a substantial influence on the macro-porosity of the pellet products. The amount of carbonaceous materials added to the raw materials and the macro-pores produced provide a positive linear correlation. In the case of coke breeze, the upper limit of 25% macro-porosity corresponds to the addition of 4% coke breeze. On the other hand, in the case of brown coal, the above upper limit corresponds to an amount of brown coal as low as 1.3%. This may be attributed to the fact that brown coal contains a great amount of volatile matter (46%) compared to coke breeze, so that the formation of pores may be accelerated by gassification of the volatile matter which gives rise to the observed high reactivity. In either case, the process for producing pellets according to the present invention imposes a limitation on the amount of carbonaceous materials added to the raw materials of up to 4%. The types of carbonaceous materials used are not critical. Thus, carbonaceous materials which may be employed in the present invention include in addition to coke breeze and brown coal referred to thus far, coals such as bituminuous coal, hard coal and the like, and charcoals, and inorganic or organic materials such as foaming styrol, starch and the like. However, carbonaceous maaterials which contain a great amount of volatile matter or tend to produce a great amount of gases are not recommended because these materials tend to produce cracking in the pellets themselves. However, the greater the calorific value of the burning carbonaceous materials, the higher the sintering degree of the grains around the macro-pores. As a result, an increase in calorific value results in the prevention of a lowering in the strength of the pellet products. For this reason, it is preferable to use high caloric carbonaceous materials, such as bituminous coal, hard coal, coke breeze and the like.

Fracture observation of pellets, after reduction, according to the tests developed by the inventors reveals that the prior art pellets which are free of carbonaceous materials are used in the present invention provide a shall layer of metallic iron in the outer peripheral portions of pellets, and exhibit evidence of retardation of reduction in the inner portions of the pellets, and that the pellets having macro-pores produced by coke breeze and the like according to the present invention are uniformly reduced through to the inner portions of pellets, although this phenomenon is more evident at high temperature reduction, rather than at a lower temperature reduction, i.e., 900° C., of the JIS technique.

According to a further preferred aspect of the present invention, a flux containing MgO is added as a raw material in the manufacture of the pellets, together with carbonaceous materials, in an attempt to raise the melting point of the slag which is formed, as well as to prevent retardation of reduction over high temperature ranges by dispersing macro-pores throughout the interior of each of the fired iron-ore pellets.

More specifically, carbonaceous materials of a grain size diameter of 0.1 to 3 mm and a flux such as dolomite containing MgO are added to the raw materials for the fabrication of the pellets in amounts of up to 4%, and up to 3%, respectively. Normally, the dolomite is of a grain size of up to 44$\mu$ and is used in an amount of over 60%. The mixture thus prepared is pelletized and fired.

The reason why the amount of MgO is limited to up to 3% is that when the amount of MgO exceeds 3%, the melting down temperature of pellets is not raised, so that the desired softening and contraction effects of the pellets are lost with an accompanying decrease in reducibility.

In addition, according to the process of the present invention, a carbonaceous material and a MgO flux of relatively large or rough sizes are mixed with other raw materials for the fabrication of the pellets in a suitable amount. Then, the mixture is pelletized to provide green pellets. Then, the green pellets are subjected to a preheating firing process to burn the carbonaceous material, thereby intentionally forming macro-pores in each of the pellets in a uniformly dispersed manner, while the ash of the carbonaceous materials, gangue mineral, flux and the like form a slag, thereby providing tightly sintered pellets.

According to yet another aspect of the present invention, the flux which can be added to the raw materials for pellet formation may be a carbonate, so that the endothermic reaction of the preheating process may be supplemented by the heat evolved by burning of the carbonaceous material.

Having generally described this invention, a further understanding can be obtained by reference to certain specific examples which are provided herein for purpose of illustration only and are not intended to be limiting unless otherwise specified.

Coke breeze as a carbonaceous material with a particle size of 0.1 to 3 mm in diameter in amounts of 0, 1.5 and 3.0% and dolomite containing MgO of a grain size distribution of 70% up to 44$\mu$ and 52% grain size distribution of up to 10$\mu$ were mixed as raw materials to form pellets of a 60 to 70% grain size distribution of up to 44$\mu$ and a 10 to 20% grain size distribution of up to 10$\mu$ respectively. Simultaneously, limestone is added to the raw materials to adjust the $CaO/SiO_2$ ratio in the raw materials to 1.2. Thereafter, the raw materials were pelletized into green pellets of sizes ranging from 10 to 12 mm in a tire type pelletizer, followed by preheating and firing in an Elema furnace under given temperature, firing duration, and oxygen partial pressure and the like condition, thereby providing fired iron-ore pellets containing slag structures and macro-pores of sizes of 0.1 to 3 mm in diameter.

The evaluation of the quality of the pellets thus prepared was made by measurements of the physical properties and metallurgical properties of the pellet products. The physical properties included the strength of the pellets to transportation and handling, the porosities of the elements which affect the strength and reducibility of the pellet products, and the amounts of FeO. The metallurgical properties include the reducibility of the pellet at high temperature, and the softening and melting down temperatures of the pellets, because, as has been described earlier, the behavior of the pellets in the belly of a blast furnace and in the lower regions thereof largely affects the yields of the blast furnace.

FIGS. 7 to 10 show the results of measurements of the pellet products in terms of the amount of coke breeze added versus the high temperature reduction degree, the softening temperature, the melting down temperature, the compressive strength, the macroporosity and the FeO amount. The term "high temperature reduction degree" means the percentage of reduction obtained when samples are reduced to FeO, and then reduced at a given temperature of 1250° C. under an atmosphere of $CO:N_2=30:70$. In addition, the softening temperature is defined as the temperature at which pellet products are heated under a load of 0.12 kg/cm$^2$ and an atmosphere of $CO:N_2=30:70$, and the contraction percent of the pellets reaches 10%. The melting temperature is defined as the temperature at which the pellets contract abruptly and then start dropping off a vessel.

Figure 7:
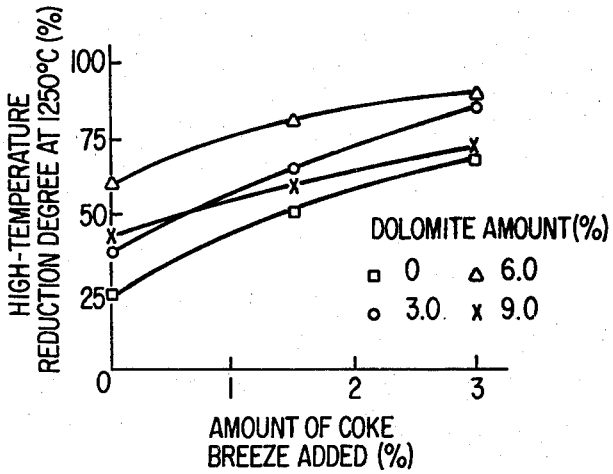
FIG. 7 is a plot showing the relationship between the amount of coke breeze which is presented in terms of the amount of dolomite added, and the degree of reduction at a high temperature (1250° C.) of iron-ore pellets.
Figure 8:
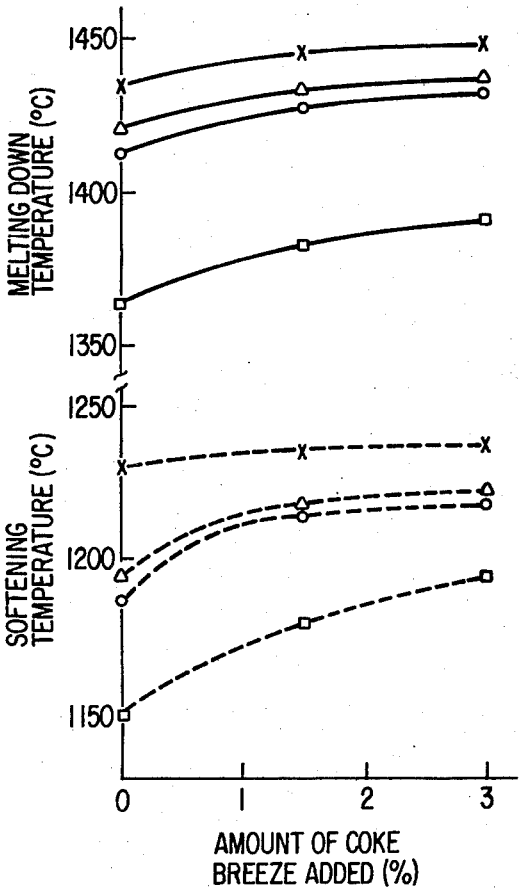
FIG. 8 is a plot showing the relationship between the amount of coke breeze in iron-ore pellets versus softening temperature, and also versus the melting down temperature.
Figure 10:
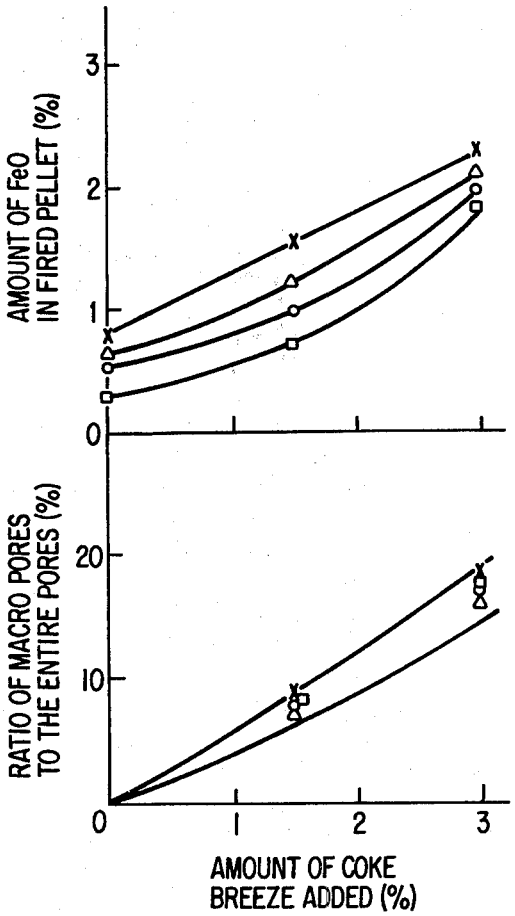
FIG. 10 is a plot showing the relationship between the ratio of macro-pores in ore pellets to all pores in the pellets, and the amount of FeO contained therein, both versus the amount of coke breeze in the pellets.

The results of these tests reveal that the high temperature properties of the pellets as shown in FIGS. 7 and 8, such as the high temperature reduction degree, the softening temperature and the melting down temperature of the pellets containing dolomite and coke breeze are improved in comparison to the properties obtained from the prior art self-fluxing pellets containing limestone. In addition, the combination of dolomite and coke breeze provides further improvements over either of these cases alone.

The high temperature reduction degree of the product peaks at an amount of dolomite of 6%. However, the combination of dolomite and coke breeze, in which coke breeze is added to 3% dolomite, is superior in effect than coke breeze when used alone. A substantial constant reduction degree is obtained with a combination of coke breeze (3%) and dolomite, regardless of the amounts of dolomite used. In other words, although the addition of dolomite is effective for improvement in the high temperature reduction degree, the dispersion of macro-pores in the pellets is largely affected by the addition of coke breeze, so that the use of coke breeze may reduce the amount of dolomite to be used. In other words, the quality of iron in the fired pellets may be improved.

The softening temperature and the melting down temperature may be both largely improved because of the addition of dolomite. The effect of coke breeze may be proved by tests on pellets free of dolomite. It is preferable in the case of the softening temperature to use a combination of dolomite and coke breeze which provides a higher softening temperature than that obtained when dolomite is used alone. This tendency is enhanced with an increase in amount of coke breeze. Particularly, the effect of coke breeze at a level of 1.5% is most remarkable.

It follows from this that the dispersion of macro-pores in the pellets because of the addition of coke breeze largely affects the reducibility of the pellets, while the softening temperature and melting down temperature are dependent on the addition of dolomite. The combined use of coke breeze and dolomite provides better results for the high temperature properties than in either case when only a single element is added alone. This is believed to result from a multiplicity effect. Accordingly, from the viewpoint of the high temperature properties, pellets containing 3 to 9% dolomite and up to 3% coke breeze are much preferable, in comparison to prior art self-fluxing pellets containing limestone.

Figure 9:
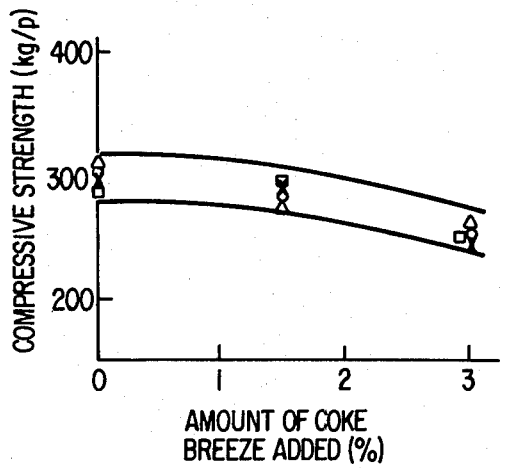
FIG. 9 is a plot showing the relationship between the amount of coke breeze added and the compressive strength of the iron-ore pellets.

Turning to the physical properties, the compressive strength of the pellets remains unchanged relative to the amounts of dolomite added, as shown in FIG. 9. An increase in the amount of coke breeze added results in a lowered compressive strength in either case. However, a lowering in the compressive strength in either case is not very significant. Even in the case of the addition of 3% coke breeze, compressive strengths of 250 kg/pellet to 270 kg/pellet may be maintained, proving that the strength is high enough for transportation and handling. The compressive strength of the pellets is governed by the amount of FeO and the porosity of the fired pellets. The addition of dolomite (MgO) and coke breeze increases the amount of FeO and the porosity. In this respect, a lowering in the compressive strength is not as significant in comparison with an increase in the amount of FeO and in the porosity. (See FIG. 10). This may be attributed to a large calorific value because of the burning of coke breeze and the improved sintering conditions of the grains around the macro-pores in the pellets.

In either case, the combined use of dolomite and coke breeze of relatively rough sizes provides an inherent advantage in their combination giving rise to excellent pellet products. Examples given thus far refer to a combination of dolomite and coke breeze. However, the present invention is by no means limited to this combination. Serpentine and magnesia clinkers may be used as flux materials because they contain MgO. In addition, inorganic and organic materials such as foaming styrol, starch and the like, other than brown coal, bituminous coal, hard coal, and the like, may be used as macro-pore-forming agents. However, it is not preferable to use macro-pore-forming agents which contain a significant volatile matter which tends to produce a great amount of gases at a relatively low temperature, i.e., less than 500° C., because such agents tend to produce cracking in the pellets.

The advantages of the present invention may be summarized as follows:

1. Pellets can be obtained in which macro-pores are dispersed, and which provide high softening and melting down temperatures because of the formation of iron oxide and a slag containing MgO, and which are free of retardation of reduction effects.
2. Although not only the porosity but also the amount of FeO in the pellet products are relatively increased, the sintering degree of the pellets may be improved because of the burned coke breeze, so that the desired compressive strength may be maintained.
3. In the preheating and firing process, the burning of the coke breeze may supplement the heat in a grate or kiln, so that the firing temperature may be raised while shortening the firing duration and hence improving the productivity of the furnace.

4. In the prior art, a magnetic concentrate is used to utilize the oxidation calorific value thereof. In contrast thereto, in the present invention a magnetite concentrate is not needed, but instead a hematite-based compensated for.
5. The addition of coke breeze may contribute to saving the amount of flux to be used.
6. Coke breeze which is normally undersized as a coke for blast furnace use has been consumed in a sintering plant. However, coke breeze in excess may be used in a pelletizing plant.

While a description has been provided for the results of tests and experiments on the present pellets, it is apparent that the present invention provides fired iron-ore pellets which are superior in high temperature properties as well as in room temperature properties in contrast to the prior art pellets. The use of pellets according to the present invention in a blast furnace may improve the gas efficiency in the furnace and ensure a high reduction degree at over high temperature ranges, thereby eliminating troubles such as the softening and sticking phenomena, the nonuniformity of gas flow, hanging, slipping and the like, thereby improving the productivity of the blast furnace, and reducing a coke ratio. In addition, the carbonaceous dust evolved from iron works may be effectively utilized.

Having now fully described the invention, it will be apparent to one of ordinary skill in the art that many changes and modifications can be made thereto without departing from the spirit or scope of the invention as set forth herein.

What is claimed is:

1. Fired iron ore pellets containing macro pores ranging from 0.1 to 3 mm in diameter dispersed throughout each of said pellets at a ratio of from 5 to 25% relative to all of the pores contained in each pellet and which have been prepared by firing a green pellet comprising up to 4% of a carbonaceous material having a grain size of from 0.1 to 3 mm, from 3 to 9% dolomite, iron ore particles wherein 60–95% of the said iron particles are up to 44$\mu$ in size and 15 to 25% of said iron ore particles are up to 10$\mu$ in size, and limestone in an amount so as to adjust the $CaO/SiO_2$ ratio to about 1.2.

* * * * *

UNITED STATES PATENT AND TRADEMARK OFFICE

CERTIFICATE OF CORRECTION

PATENT NO. : 4,231,797

DATED : November 4, 1980

INVENTOR(S) : Isao Fujita et al

It is certified that error appears in the above-identified patent and that said Letters Patent are hereby corrected as shown below:

Please correct the spelling of the fourth inventor's name to read as follows:

[75] Inventors: Isao Fujita, Kobe; Mamoru Onoda, Miki; Fumikazu Kawaguchi, Kobe; Yoshimichi Takenaka, Kobe, Tadao Tsutaya, Kobe; ALL OF JAPAN Signed and Sealed this

*Thirteenth* Day of *January 1981*

[SEAL]

*Attest:*

SIDNEY A. DIAMOND

*Attesting Officer*

*Commissioner of Patents and Trademarks*